United States Patent [19]

Müller

[11] 4,195,682

[45] Apr. 1, 1980

[54] METHOD AND APPARATUS FOR PROVIDING AIR VENTS OR HOLES IN CASTING MOLES OF MOLDING SAND

[75] Inventor: Günter Müller, Karlsruhe, Fed. Rep. of Germany

[73] Assignee: ARENCO-BMD Maschinenfabrik GmbH, Fed. Rep. of Germany

[21] Appl. No.: 915,677

[22] Filed: Jun. 15, 1978

[30] Foreign Application Priority Data

Jun. 15, 1977 [DE] Fed. Rep. of Germany ..... 2726876

[51] Int. Cl.[2] ..... B22C 23/00

[52] U.S. Cl. ..... 164/6; 164/234; 164/410; 408/56

[58] Field of Search ..... 164/410, 234, 6, 17, 164/161; 408/56, 58; 90/11 R; 29/DIG. 61, DIG. 78

[56] References Cited

U.S. PATENT DOCUMENTS

| | | | |
|---|---|---|---|
| 3,033,298 | 5/1962 | Johnson | 408/58 X |
| 3,227,010 | 1/1966 | Daubner et al. | 408/56 X |

FOREIGN PATENT DOCUMENTS

| | | | |
|---|---|---|---|
| 48-29014 | 9/1973 | Japan | 164/410 |
| 48-34092 | 10/1973 | Japan | 164/17 |

*Primary Examiner*—Robert D. Baldwin
*Assistant Examiner*—Gus T. Hampilos
*Attorney, Agent, or Firm*—Craig and Antonelli

[57] ABSTRACT

A method for forming at least one air vent or hole in a casting mold made of molding said and having a top flask with at least one blind hole originating at its parting plane with a bottom flask comprises the steps of pressurizing the mold cavity and drilling the air vent or hole into communication with the blind hole while drawing off the materials produced by drilling directly at the drilling point. An apparatus for performing the above-noted method includes, according to a preferred embodiment, a source of compressed gas having a pressure hood mountable over the inlet of the mold, and a drilling tool disposed within a suction hood which is placed in a sealing engagement with the top flask after the drilling tool has been properly aligned with the blind hole that is to form part of the air vent or hole.

7 Claims, 1 Drawing Figure

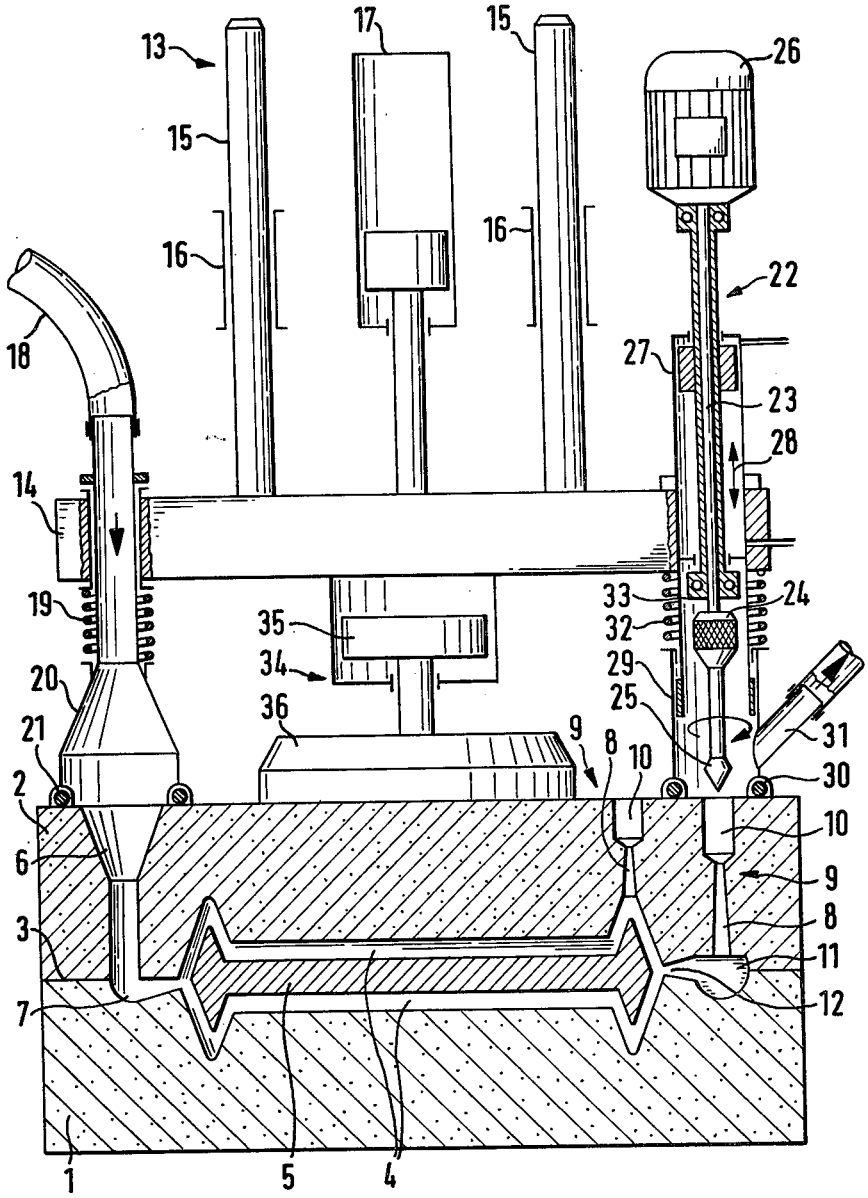
13
15
16
17
15
16
26
22
18
27
23
28
14
19
33
24
32
35
34
29
20
25
36
31
21
9
8
10
30
2
10
6
9
3
8
11
7
12
1
5
4

METHOD AND APPARATUS FOR PROVIDING AIR VENTS OR HOLES IN CASTING MOLES OF MOLDING SAND

BACKGROUND AND SUMMARY OF THE INVENTION

The invention relates to a method for providing air vents or holes in casting molds made of molding sand and composed of a top flask and a bottom flask, the top flask of the casting molds being provided with conical blind holes originating at the mold parting plane, said holes having to be drilled to form the air vents or holes.

The invention can be used advantageously both for flask molds and for flaskless molds, whenever air vents and/or holes must be provided after the top flask is placed on top of the bottom flask.

If the top flask and bottom flask are manufactured on separate machines and transported (for example, by a conveyor belt) to an assembling machine in which the top flask is placed on top of the bottom flask, the provision of air holes and vents in the top flask poses no difficulty. Drills are used for this purpose which can be adjusted to the positions of the existing blind holes in the top flask, so that the blind holes can be drilled in the upper surface of the top flask. The sand generated by the drilling process can be allowed to fall downward onto the conveyor belt. The top flask is then put in position. Drilling must be performed before the top and bottom flask are assembled, since otherwise sand will enter the mold cavity.

Procedures have already been developed for squeeze molding machines and jolt squeeze molding machines such that conical vent rods are provided on the model plate which shape the air vents during the molding process. If the air vents must be made in the form of through holes for their entire length, this assumes that corresponding holes to accept the vent wires are provided in the molding plate which acts on the upper surface of the top flask, so that the vent wires can enter the plate during the molding process and will not be bent. This process is especially well known in single-station molding machinery for flaskless molds, in which the top flask and bottom flask are prepared simultaneously. This process has the disadvantage that when models are changed, a different molding plate must be installed since the air vents will generally be located at different positions.

Therefore, a goal of the present invention is to provide a method and a device by which air vents or holes can be provided subsequently after the top flask is placed on the bottom flask.

This goal is achieved by using a technique in which the mold chamber is pressurized and the material created by drilling is drawn off directly upward at the drilling point.

The overpressure in the mold and the underpressure at the drilling point cause a violent flow through the drill hole out of the mold chamber when the blind hole breaks through, so that the material loosened by drilling cannot fall into the mold cavity. The overpressure and underpressure which prevail simultaneously at the drilling point allow a relatively low overpressure to be used in the mold cavity so that the mold will not be overly stressed. In addition, the loose material which is produced during drilling until the hole breaks through is drawn away constantly, so that only a small amount of material needs to be removed when the hole finally breaks through.

According to one embodiment of this method, an additional force is constantly exerted on the top flask, said force, together with the weight of the top flask, being greater than the pressures prevailing in the mold cavity. This prevents the top flask from being lifted up.

In order to achieve the goal from an engineering stand-point, the invention is based upon those casting molds in which a trumpet is premolded in the top flask in addition to the blind holes to form the air vents and risers. In addition, the invention uses a conventional drill. According to the invention, a device for providing the air vents and holes is characterized by a support disposed above the top flask, said support being provided with a compressed air line which can be connected to the top flask at the trumpet location and a drill which can be adjusted to the positions of the blind holes, said drill being associated with a suction air line which can be mounted on the top flask.

The device can be provided in the form of an assembly which can be mounted directly behind the molding machine or behind the assembling machine. The compressed air line is lowered to the trumpet location on the top flask, while the suction air line is applied at the location of an air hole or vent on the top flask. Then compressed air is blown into the trumpet through the compressed air line; the air spreads out in the mold cavity and enters the blind holes, so that the entire mold is pressurized. Then the drill is lowered and the blind hole drilled. The molding sand which is loosened by the drilling is drawn off constantly by the vacuum in the suction air line. At the moment when the drill breaks through the blind hole, the compressed air escapes so that the sand is blown away in the direction of the suction line. This prevents any molding sand from entering the molding cavity.

The above-described embodiment of the process can be worked industrially using an additional feature of the invention, providing a device on the support which holds the top flask down, said device counterbalancing the upward push exerted by the top flask by virtue of the overpressure prevailing inside it. In the simplest case, this can be a large weight or a hold-down plate actuated by a pressure medium, whereby the pressure acting on the hold-down plate can be adjusted to the overpressure in the mold.

According to one embodiment of the invention, the compressed air line is provided with a removable hood which can be mounted on the trumpet at the point where the compressed air line terminates. The size of the hood can be adjusted so that the trumpet is always covered by the hood, although its cross section and position may vary, thus doing away with the need to adjust the compressed air line in the horizontal plane.

The compressed air and suction air lines are advantageously displaceable vertically against spring force relative to the support. Likewise, the support is vertically movable on fixed guides. When the support is lowered in the direction of the top flask, the compressed air and suction air lines come in contact with the top flask and are free to move relative to the springs supporting them, so that on the one hand the force exerted by these parts on the top flask can be limited to a certain value and on the other hand the pressure is sufficient to provide a reliable seal between the lines and the surface of the top flask. This seal can be further reinforced by providing the hood of the compressed air line and the suction air line with a seal at the end facing the top flask.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWING

The single FIGURE of the drawing is a schematic side view partially cut away of a sand mold and the apparatus according to the preferred embodiment of the invention.

DETAILED DESCRIPTION OF THE PREFERRED EMBODIMENT

In the drawing, a flaskless sand mold, consisting of bottom flask 1 and top flask 2 is shown schematically. On both sides of the mold-parting plane 3, there is a mold cavity 4 formed by the model plates, in which a mold core 5 is located. Top flask 2 is provided with a trumpet 6, said trumpet communicating with mold cavity 4 through a channel 7 formed in bottom flask 1. In addition, top flask 2 is provided with two air vents 9, one part of which 8, in the form of conical blind holes which terminate in front of expansion 10, are formed during the manufacture of top flask 2 with the aid of vent wires disposed on the model plate, while expansion 10, forming a second part of the vents 9, is formed afterward by drilling, as will be discussed in greater detail below.

In the embodiment shown, the top flask and bottom flask 1 and 2 are also provided with a blind expansion 11 disposed laterally with respect to mold cavity 4, said expansion communicating with mold cavity 4 via a narrow cross section 12. Cross section 12 is made sufficiently narrow that only air but not liquid material can pass through into blind expansion 11.

The device labeled 13 is used to drill blind holes 8 or to produce expansions 10 for air vents 9. Device 13 consists of a girder-shaped support 14, mounted vertically movably by rods 15 in guides 16, and driven in the embodiment shown by a pressurized cylinder 17. Device 13 can be disposed as a swivelable assembly on a molding machine or at any point in the molding area behind the molding machine.

A compressed air line 18 is suspended on support 14, said line being supported on support 14 by a spring 19. Pressure line 18 expands in the vicinity of its mouth to form a hood 20, provided at its end with a seal 21. In the operating position shown in the drawing, the hood is elastically supported on the upper surface of top flask 2 under the action of spring 19, whereby seal 21 seals trumpet 6 in an air-tight manner against the environment.

A drill 22 is also mounted on support 14, said drill being provided with a chuck 24 on a drill rod 23, in which chuck a drilling tool 25 can be interchangeably mounted. Drill 25 is driven by electric motor 26. In addition, the entire drill assembly 22 can be raised and lowered in the direction indicated by double arrow 28 by a pressurized cylinder 27.

Chuck 24 and drilling tool 25 are disposed in a hood 29 which is also provided with a seal 30 at its end. A suction line 31 is connected to the side of hood 29. Hood 29 is subjected to the action of a spring 32, like hood 20 for compressed air line 18, and fits over a tubular projection 33 on drill 22 in an air-tight manner.

Device 13 is also provided with a hold-down device 34, which in the embodiment shown consists of a pressurized cylinder 35 and a hold-down plate 36.

To form the air vents, the drill 22 is first adjusted to the horizontal position of one of the blind holes 8. For this purpose, drill 22 can be mounted for example on a knee lever, a linkage, or any other suitable guide arrangement in order to be able to be brought into any position. Then support 14 is lowered until seals 21 and 30 come to rest upon the surface of top flask 2 and springs 19, 32 are compressed to a slight degree in order to produce the necessary sealing force. Then compressed air is blown into mold cavity 4 through line 18 and trumpet 6, until a certain overpressure has been produced therein. Then drill 22 is lowered and drilling tool 25 begins rotating, whereby the loose molding sand which is produced as the expansions 10 are formed is drawn off through suction air line 31. Drill rod 23 is then lowered until blind hole 8 breaks through, whereupon the overpressure prevailing in mold cavity 4 is exhausted via hole 8 and expansion 10 in the direction of suction air line 31, carrying away the loose molding sand with it.

Depending on the size of the mold and the required overpressure, hold-down device 34 can be operated before the compressed air is supplied, with hold-down plate 36 being lowered onto top flask 2 so that the top flask is prevented from being lifted up.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A method for forming at least one air vent or hole in a casting mold comprising the steps of:

(a) providing a casting mold having top and bottom mold parts joined at a parting plane to define a mold cavity, the top part having at least one blind hole originating at the parting plane of said top part and an inlet;

(b) pressurizing said mold cavity by connecting a source of compressed gas to said inlet;

(c) drilling said air vent or hole into communicaton with said blind hole while drawing off the materials produced by drilling directly at the drilling point by drilling said vent or hole with a drilling tool disposed within a suction hood.

2. A method according to claim 1, comprising the further step of applying an additional force to at least one of said mold parts which is greater than the pressure within said mold cavity to prevent separation of the mold parts due to pressurization of the mold cavity.

3. In apparatus of the type for forming at least one air vent or hole in a casting mold, the top of the mold having an inlet sprue and at least one blind hole originating at the parting plane to the mold top the improvement comprising:

(a) a displaceable support structure;

(b) pressurizing means for supplying a pressurizing fluid comprising a source of positive pressure connected to a hood having an open end sealingly engageable with a top surface of a mold about a mold sprue, said pressurizing means being connected to said support structure;

(c) means for drilling connected to said support structure;

(d) vacuum means for withdrawing particles produced by drilling comprising a source of negative pressure connected to a vacuum hood having an open end sealingly engageable with the top surface of the mold, said vacuum means surrounding said means for drilling and being connected to said support structure; and (e) hold down means for applying a holding force, said hold down means being connected to said support structure and displaceable independently thereof.

4. Apparatus according to claim 3, wherein said drilling tool is horizontally displaceable to provide proper alignment with the blind hole.

5. An apparatus according to claim 3, wherein said hold down means comprises a hold-down plate and a pressure medium actuated displacement mechanism attached thereto.

6. An apparatus according to claim 3, further comprising means for resiliently biasing said pressure hood into sealing engagement with the top flask.

7. An apparatus according to claim 6, wherein the means for resiliently biasing comprises a spring mounted about a vertical guiding means for said pressure hood.

* * * * *